United States Patent [19]

Johnson

[11] 4,362,172

[45] Dec. 7, 1982

[54] CIGARETTE FILTER

[75] Inventor: Robert R. Johnson, Louisville, Ky.

[73] Assignee: Brown & Williamson Tobacco Corporation, Louisville, Ky.

[21] Appl. No.: 211,491

[22] Filed: Dec. 1, 1980

[51] Int. Cl.[3] ..... A24D 3/04

[52] U.S. Cl. ..... 131/336; 131/361; 131/362; 131/363

[58] Field of Search ..... 131/336, 339, 340, 338, 131/198 R, 198 A, 216, 229, 361, 362, 363

[56] References Cited

U.S. PATENT DOCUMENTS 3,490,461 1/1970 Osmalov et al. ..... 131/336

3,607,512 9/1971 Mathe ..... 131/340

*Primary Examiner*—V. Millin

*Attorney, Agent, or Firm*—Charles G. Lamb

[57] ABSTRACT

A filter for a cigarette includes a porous filter rod circumscribed by a non-porous wrapper and a tipping material having selected openings therein for allowing ventilating air to pass therethrough. Spacing members are disposed between the non-porous wrapper and tipping material to form ventilating air channels therebetween.

8 Claims, 4 Drawing Figures

CIGARETTE FILTER

BACKGROUND OF THE INVENTION

1. Field of the Invention

This invention relates to filters for cigarettes. In one aspect, it relates to a filter with novel ventilating means therein. In another aspect, the invention relates to a filter cigarette having flow directing channels therein for directing ventilating air between non-porous wrapping material and air permeable tipping material.

2. Description of the Prior Art

It is well known in the art to add filters to cigarettes wherein the filters are provided with ventilating means to bring ambient air into the filter to dilute the smoke stream. The dilution of the smoke stream reduces the quantity of smoke particulates as well as gas phase components which are delivered to the mouth of the smoker. A number of means have been proposed and are utilized for introducing ventilating air into the cigarette. For example, the wrapper for the tobacco in a cigarette can be made from a porous material which allows for introduction of air along the entire length of the cigarette where it mixes with the smoke stream passing therethrough, thereby diluting the smoke in the stream. Also, the cigarette wrapper may be perforated at selected locations along the length of the cigarette which provides ports for the cigarette through which ventilating air enters. Even further, it is known to perforate the wrapper of the filter on the filter end of the cigarette to allow for ventilating air to enter the filter for dilution of the smoke stream. There have also been a number of suggestions for incorporating grooes or channels within the filter end for the cigarette in order to facilitate the addition of ventilating air into the smoke stream.

For example, U.S. Pat. No. 3,596,663 relates to a tobacco smoke filter provided with a corrugated porous plug wrap surrounding a filter element which is circumscribed by a tipping paper having flow-through perforations therein whereby ventilating air enters directly into the filter element or progresses down the grooves to the smoker's mouth. Other patents which relate to cigarette filters having grooves or channels circumscribing the filter element for the introduction of ventilating air into the filtering end of the filter cigarette include U.S. Pat. No. 3,577,995; U.S. Pat. No. 3,572,347; U.S. Pat. No. 3,490,461; U.S. Pat. No. 1,718,122; U.S. Pat. No. 3,788,330; U.S. Pat. No. 3,773,053; U.S. Pat. No. 3,752,165; U.S. Pat. No. 3,638,661; U.S. Pat. No. 3,608,561; and, U.S. Pat. No. 3,910,288.

SUMMARY OF THE INVENTION

The present invention advantageously provides a straight forward arrangement of a filter for a cigarette which in one form achieves normal cigarette pressure drop with low to moderate efficiency filters. The present invention further provides a cigarette filter for lowering tar by ventilation incombination with filtration. The present invention even further provides a filter ventilation system for a cigarette utilizing channels therein between non-porous filter plug and tipping material having perforations therein extending from a preselected distance therealong.

Various other features of the present invention will become obvious to those skilled in the art upon reading the disclosure set forth hereinafter.

More particularly, the present invention provides a filter for a cigarette comprising a porous filter rod of cylindrical configuration; a non-porous wrapper extending longitudinally of and circumscribing the rod leaving flow-through opposed ends of the rod; tipping material extending longitudinally of and circumscribing the wrapper, the tipping material including flow-through openings therein; and, spacing meand disposed between the wrapper and the tipping material, the spacing means extending a preselected distance therealong to define ventilating air channels between the wrapper and the tipping material.

It is to be understood that the description of the examples of the present invention given hereinafter are not by way of limitation and various modifications within the scope of the present invention will occur to those skilled in the art upon reading the disclosure set forth hereinafter.

BRIEF DESCRIPTION OF THE DRAWING

Referring to the drawing.

DESCRIPTION OF THE PREFERRED EMBODIMENT

Figure 1:
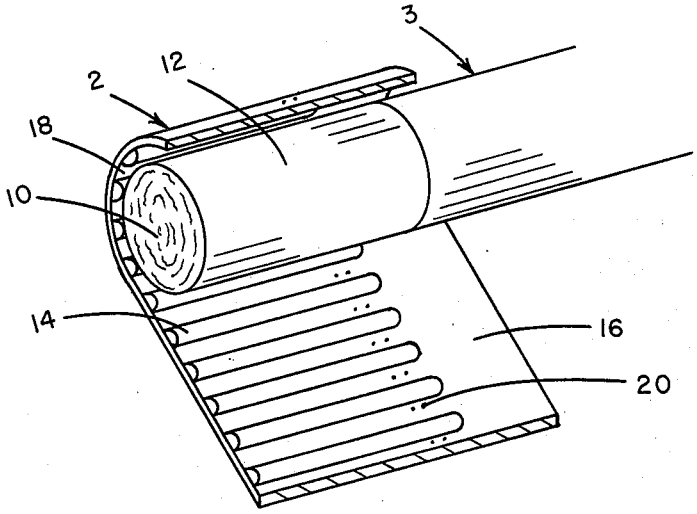
FIG. 1 is a perspective view of a preferred filter element of the present invention attached to a cigarette tobacco column with tipping material shown in an unwrapped condition.

In FIG. 1, a filter plug 2 of the present invention is shown attached to a cigarette tobacco column 3. This filter plug 2 comprises a cellulose acetate filter element 10 or any other filter made from fibrous or foamed materials for tobacco smoke which may be known in the art circumscribed by a non-porous wrapper 12. It is realized that in the use of the term "non-porous" or "smoke impervious wrapper", this includes non-porous outer surfaces of foamed material which are integral with the filter element as well as non-porous wrapping material which is not integral with the filter element. The filter plug 2 is provided with a plurality of spacing members 14 extending longitudinally therealong from the mouth end of the filter to a preselected distance therefrom. The spacing members 14 are shown as being ridges of "hot melt" adhesive disposed between the plug wrap 12 and the tipping material 16. The spacing members 14 define channels 18 therebetween which provide the passageways for the venilating air to enter the smoker's mouth during normal smoke draw. It is realized that other spacing means may be provided without departing from the scope and spirit of the present invention.

Figure 2:
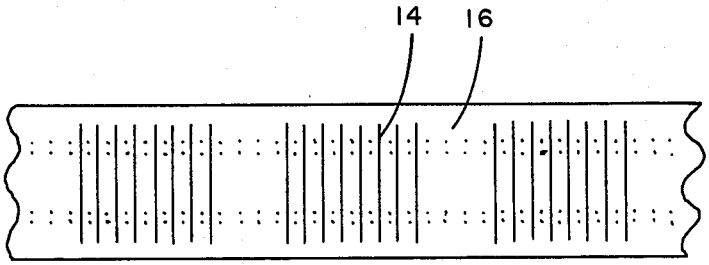
FIG. 2 is a plan view of a sheet of tipping material used in FIG. 1 with spacing means attached thereto; and, FIG. 3 is a perspective view of the preferred filter element of FIG. 1 in a reversed attachment to a cigarette tobacco column; and, FIG. 4 is a perspective view of another preferred filter element of the present invention attached to a cigarette tobacco column with tipping material shown in an unwrapped condition.

The filter plugs 2 are generally prepared by taking a standard filter rod of cellulose acetate or the like, wrapping the rod with a non-porous or smoke impervious wrapping material, then circumscribing the wrapped filter rod with tipping material which has "hot melt" or other spacing means attached at preselected positions thereon as best shown in FIG. 2. It is realized that other means may be utilized for forming the channels 18, but use of a "hot melt" adhesive which has set-up on the tipping material is one preferred means. For example, ridged coatings of a plastic or polymer material may be used as the spacing means. The coating may be thermoplastic or a thermosetting. Furthermore, it may be applied by any means known in the art, such as, as mentioned, as "hot melt" adhesive, or it may be applied in dispersion or in solution when used with a compatible vehicle for applying.

The tipping material 16 may be air pervious or air impervious. If air impervious, perforations must be made in the tipping material at preselected locations to provide flow-through communication with the channels 18. In FIG. 1, perforations 20 are provided to allow for the passage of ventilating air through tipping material 16 into the channels 18. During normal smoke draw, ventilating air enters through the tipping perforations 20 and travels down the channels 18 into the smoker's mouth.

Figure 3:
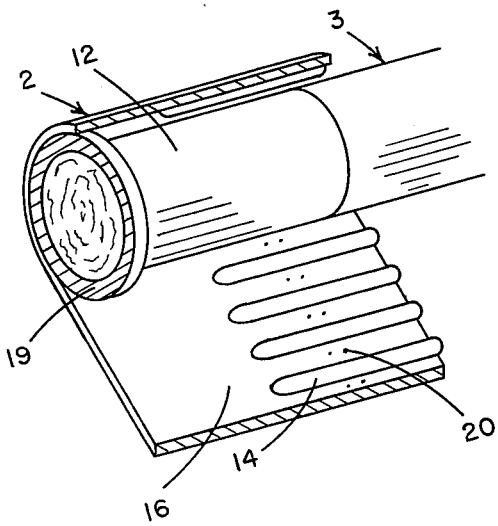

In FIG. 3, the filter plug 2 shown in FIG. 1 is reversed so that ventilating air entering through the tipping perforations 20 travels down the channels 18 into the tobacco column 3 during normal smoke draw.

In some instances, it is necessary to provide spacing means between the plug wrap 12 and the tipping paper 16. In FIG. 3, a spacing ring 19 is provided at the mouth end of the filter. Spacing ring 19 may be a separate member made of a fibrous material, plastic or the like, or it may be unitary with the tipping paper 16, such as an adhesive as used for the spacing members 14.

Figure 4:
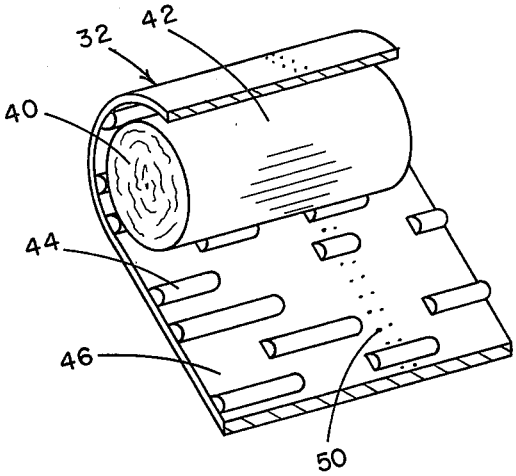

In FIG. 4, a filter plug 32 of the present invention is shown. This filter plug 32 comprises a filter element 40 made from fibrous or foamed materials for tobacco smoke which may be known in the art circumscribed by a non-porous wrapper 42. The filter plug 32 is provided with a plurality of spacing members 44 which are a plurality of irregular shaped members disposed between plug wrap 42 and tipping material 46 to provide passageways for ventilating air passing therebetween. The spacing members 44 may be "hot melt" adhesive or any other means for spacing which may be known in the art. Tipping material or paper 46 is provided with perforations 50 therein providing means for the passage of ventilating air therethrough.

In FIG. 4, only the filter plug 32 is shown and it is realized that either end of the plug 32 may be attached to a cigarette tobacco column depending upon the direction desired for the flow of ventilating air between the plug wrap and the tipping material.

It will be realized that various changes may be made to the specific embodiments shown and described without departing from the principles and scope of the present invention.

What is claimed is:

1. A filter for a cigarette comprising:

a porous filter rod of cylindrical configuration;

a smoke impervious wrapper extending longitudinally along said rod from one end thereof and circumscribing said rod leaving flow-through opposed ends of said rod;

tipping material extending longitudinally of and circumscribing said wrapper, said tipping material being provided with means permitting ventilating air flow therethrough; and, spacing means disposed between and non-unitary with said wrapper and said tipping material, said spacing means including a plurality of spaced parallel longitudinal members extending a preselected distance therealong defining ventilating air channels between said wrapper and said tipping material, ventilating air being the only fluid flowing through said channels when the filter is used in combination with a cigarette tobacco column during smoke draw.

2. The filter of claim 1 in combination with a cigarette tobacco column, said channels of said filter being in flow-communication with the smoker's mouth.

3. The filter of claim 1 wherein said tipping material is permeable to air.

4. The filter of claim 1 wherein said tipping is impervious to air, said tipping material having selective perforations therein in flow-communication with said grooves.

5. The filter of claim 1, said non-porous wrapper being integral with said porous filter rod.

6. The filter of claim 1, said spacing means being spaced parallel rows of ridges of "hot melt" adhesive.

7. The filter of claim 1 in combination with a cigarette tobacco column, said channels of said filter being in flow-communication with said tobacco column.

8. The filter of claim 1, including a circumferential spacing member disposed between said tipping material and said wrapper.

* * * * *